US010297372B2

(12) United States Patent
Perego

(10) Patent No.: US 10,297,372 B2
(45) Date of Patent: May 21, 2019

(54) PROCESS FOR PRODUCING AN ENERGY CABLE HAVING A THERMOPLASTIC ELECTRICALLY INSULATING LAYER

(71) Applicant: PRYSMIAN S.p.A., Milan (IT)

(72) Inventor: Gabriele Perego, Milan (IT)

(73) Assignee: PRYSMIAN S.P.A, Milan (IT)

( * ) Notice: Subject to any disclaimer, the term of this patent is extended or adjusted under 35 U.S.C. 154(b) by 726 days.

(21) Appl. No.: 14/687,228

(22) Filed: Apr. 15, 2015

(65) Prior Publication Data

US 2015/0221420 A1 Aug. 6, 2015

Related U.S. Application Data

(63) Continuation of application No. 14/401,656, filed as application No. PCT/IB2012/052507 on May 18, 2012, now abandoned.

(51) Int. Cl.
*H01B 13/14* (2006.01)

(52) U.S. Cl.
CPC ..... *H01B 13/148* (2013.01); *H01B 13/14* (2013.01)

(58) Field of Classification Search
CPC ..... H01B 13/148; H01B 13/14
See application file for complete search history.

(56) References Cited

U.S. PATENT DOCUMENTS 3,445,394 A 5/1969 Hunt
2004/0038030 A1 2/2004 Castellani et al.
(Continued)

FOREIGN PATENT DOCUMENTS

GB 1 303 334 1/1973
RU 2399105 9/2010
(Continued)

OTHER PUBLICATIONS

Decision on Grant of Patent for Invention from the Russian Patent Office, in counterpart Russian Application No. 2014150555/07(081042) (dated May 18, 2012).
(Continued)

*Primary Examiner* — Robert J Grun
(74) *Attorney, Agent, or Firm* — Finnegan, Henderson, Farabow, Garrett & Dunner, L.L.P.

(57) ABSTRACT

A process for producing an energy cable including at least one electrically conductive core and at least one thermoplastic electrically insulating layer, includes the steps of: impregnating a thermoplastic material in subdivided solid form, having a melting enthalpy equal to or lower than 70 J/g, with a dielectric fluid to obtain an impregnated thermoplastic material; feeding the impregnated thermoplastic material in subdivided solid form to a single-screw extruder; and extruding the impregnated thermoplastic material onto the at least one electrically conductive core, so as to form the at least one thermoplastic electrically insulating layer, whereby the impregnated thermoplastic material is not subjected to any mechanical homogenization step in a molten state. Energy cables having a large amount of the dielectric fluid in the electrically insulting layer, e.g. higher than 10 wt %, are obtained without showing any morphological defects in the layer itself and any drawbacks in the extrusion process, even when the rotation speed of the extruder screw, and therefore, the cable production speed, are high (e.g. higher than 20 m/min for medium voltage cable).

20 Claims, 2 Drawing Sheets

(56) References Cited

U.S. PATENT DOCUMENTS

| | | | |
|---|---|---|---|
| 2004/0091631 | A1 | 5/2004 | Belli et al. |
| 2006/0124341 | A1 | 6/2006 | Perego et al. |

FOREIGN PATENT DOCUMENTS

| | | |
|---|---|---|
| RU | 99895 | 11/2010 |
| WO | WO 98/52197 | 11/1998 |
| WO | WO 02/03398 | 1/2002 |
| WO | WO 02/27731 | 4/2002 |
| WO | WO 02/47092 | 6/2002 |
| WO | WO 2004/066317 | 8/2004 |
| WO | WO 2004/066318 | 8/2004 |
| WO | WO 2007/048422 | 5/2007 |
| WO | WO 2008/058572 | 5/2008 |
| WO | WO 2011/092533 | 8/2011 |

OTHER PUBLICATIONS

International Search Report from the European Patent Office for International Application No. PCT/IB2012/052507, dated Feb. 19, 2013.

Written Opinion of the International Searching Authority from the European Patent Office for International Application No. PCT/IB2012/052507, dated Feb. 19, 2013.

Designation: D 3238-95; "Standard Test Method for Calculation of Carbon Distribution and Structual Group Analysis of Petroleum Oils by the n-d-M Method", Annual Book of ASTM Standards, vol. 05.01, pp. 1-3 (2000).

PROCESS FOR PRODUCING AN ENERGY CABLE HAVING A THERMOPLASTIC ELECTRICALLY INSULATING LAYER

CROSS REFERENCE TO RELATED APPLICATIONS

This application is a continuation of U.S. application Ser. No. 14/401,656, filed Nov. 17, 2014, which is a national phase application based on PCT/IB2012/052507, filed May 18, 2012, the content of each application being incorporated herein by reference.

BACKGROUND OF THE INVENTION

The present invention relates to a process for producing an energy cable. In particular, the present invention relates to a process for producing an energy cable for transporting or distributing electric energy, especially medium or high voltage electric energy, said cable having at least one thermoplastic electrically insulating layer.

Cables for transporting electric energy generally include at least one cable core. The cable core is usually formed by at least one conductor sequentially covered by an inner polymeric layer having semiconductive properties, an intermediate polymeric layer having electrically insulating properties, an outer polymeric layer having semiconductive properties. Cables for transporting medium or high voltage electric energy generally include at least one cable core surrounded by at least one screen layer, typically made of metal or of metal and polymeric material. The screen layer can be made in form of wires (braids), of a tape helically wound around the cable core or a sheet longitudinally surrounding the cable core. The polymeric layers surrounding the at least one conductor are commonly made from a polyolefin-based crosslinked polymer, in particular crosslinked polyethylene (XLPE), or elastomeric ethylene/propylene (EPR) or ethylene/propylene/diene (EPDM) copolymers, also crosslinked, as disclosed, e.g., in WO 98/52197. The crosslinking step, carried out after extruding the polymeric material onto the conductor, gives the material satisfactory mechanical and electrical properties even under high temperatures both during continuous use and with current overload.

To address requirements for materials which should not be harmful to the environment both during production and during use, and which should be recyclable at the end of the cable life, energy cables have been recently developed having a cable core made from thermoplastic materials, i.e. polymeric materials which are not crosslinked and thus can be recycled at the end of the cable life.

In this respect, energy cables comprising at least one coating layer, for example the insulation layer, based on a polypropylene matrix intimately admixed with a dielectric fluid are known and disclosed, for example, in WO 02/03398, WO 02/27731, WO 04/066317, WO 04/066318, WO 07/048422, WO 08/058572, and WO 11/092533. The polypropylene matrix useful for this kind of cables comprises polypropylene homopolymer or copolymer or both, characterized by a relatively low cristallinity such to provide the cable with a suitable flexibility, but not to impair mechanical properties and thermopressure resistance at the cable operative and overload temperatures. Performance of the cable coating, especially of the cable insulating layer, is also affected by the presence of the dielectric fluid intimately admixed with said polypropylene matrix. The dielectric fluid should not impair the above mentioned mechanical properties and thermopressure resistance and should be intimately and homogeneously admixed with the polymeric matrix.

For an industrial production of the above energy cables having a thermoplastic electrically insulating layer it is therefore necessary to envisage and develop a process which allows to homogenously admix the dielectric fluid with the thermoplastic material in a predetermined amount, without prejudicing stability of the extrusion process, which can be negatively influenced by the presence of the dielectric fluid in the early extrusion steps, when the polymer is not yet molten. In fact, because of the lubricant properties of the dielectric fluid, it can cause irregularities in the movement and plasticization of the polymeric material along the extruder barrel.

A possible solution to the above technical problem is described in the International Patent Application WO 02/47092, which relates to a process for producing a cable provided with at least one thermoplastic coating, which comprises: extruding a thermoplastic polymer and at least one dielectric liquid; passing said thermoplastic material through at least one static mixer, depositing and shaping said thermoplastic material around a conductor so as to obtain a layer of thermoplastic coating on said conductor. The addition of the dielectric liquid to the thermoplastic polymer is preferably carried out, as shown in the working examples, by injecting the liquid into the extruder in a zone wherein the polymer is already in a molten state, i.e. in a downstream zone of the extruder. Possibly, according to an alternative solution, the dielectric liquid may be added to the thermoplastic polymer when said polymer is in the solid state, namely: a) during the feeding of the thermoplastic polymer into the extruder, b) before the above feeding; or c) in a zone of the extruder wherein the thermoplastic polymer is in a solid state. In case b), the addition of the dielectric liquid can be carried out during a previous step of compounding the polymer in a mixer (batchwise or continuously) or by impregnating the polymer in the form of granules or powder. In any event, according to the disclosure of WO 02/47092, to obtain a dielectric liquid uniformly distributed throughout the cable coating, a homogenization step must be performed downstream of the extrusion step by means of a static mixer.

International Patent Application WO 02/27731 relates to a cable comprising at least one electrical conductor and at least one extruded covering layer based on a thermoplastic polymer material in admixture with a dielectric liquid. The mixing of the polymer base with the dielectric liquid may be carried out, for example, by an internal mixer having tangential or interpenetrating rotors, or by a continuous mixer, e.g. a Ko-Kneader (Buss) mixer or a co- or counter-rotating double-screw extruder. In the working examples, it is reported a method for obtaining cable specimens to be subjected to dielectric strength measurements, wherein the propylene homopolymer or copolymer in the form of granules and the dielectric liquid, along with an antioxidant, were fed into a double-screw extruder. The so obtained mixture was then passed into a single-screw extruder for further homogenization and filtered. The filtered mixture was then fed into another extruder, filtered again and then passed into a triple head for deposition, simultaneously with the semiconductive layers to form a triple layer on the metal conductor. Other dielectric strength measurements were performed on glass-shaped specimens of the above thermoplastic composition which were obtained by moulding discs of the insulating material which were previously produced starting from granules of the polymeric material impregnated with the dielectric liquid as follows. The polymer in granular form was preheated to 80° C. in a turbomixer, then the dielectric liquid was added to the granules under agitation at 80° C. for 15 minutes. After addition the agitation was continued for a further hour at 80° C. until the liquid was completely absorbed in the polymer granules. Afterwards, the material was kneaded in a laboratory double-screw at a temperature of 185° C. to complete homogenization. The material left the double-screw mixer in the form of granules, which were then compressed to form discs and then moulded to obtain the glass-shaped specimens.

U.S. Pat. No. 3,445,394 relates to a dielectric composition consisting of a solid phase polyolefin, in particular polyethylene, having dispersed therein an aromatic hydrocarbon oil and a voltage stabilizing additive. The additive-oil blends are also effective as voltage stabilizers in high density (low pressure) polyethylene and in other polyolefins, e.g. polyproylene. The blend of highly aromatic hydrocarbons and voltage stabilizing additive is used in the polyolefin in an amount effective to act as a voltage stabilizer, particularly an amount of from 1 to 10% by weight based on the amount of the polyolefin. The compositions are prepared by blending the oil and the stabilizer. Then the blend is added to a tumbling bin into which the polyolefin has previously been introduced. The polyolefin is granular and absorbs the blend upon tumbling. Subsequently the tumbled composition is shaped by extrusion to form wire insulation.

In GB Patent No. 1,303,334 an electric cable or wire is disclosed having an insulation comprising a solid olefin polymer together with one or more voltage stabilizers constituted by polymerisable aromatic or other cyclic monomeric compounds. These monomeric compounds may, for example, be introduced into the olefin polymer by impregnation of granular olefin polymer before extrusion. Even very small amounts of the voltage stabilizer, e.g. 0.1% of styrene, are sufficient to achieve a substantial improvement in the dielectric strength of the insulation.

SUMMARY OF THE INVENTION

According to the Applicant's experience, in principle it is possible to further improve dielectric strength of a thermoplastic material as disclosed above by increasing the amount of the dielectric fluid added therein. However, a large amount of the dielectric fluid, e.g. higher than 10 wt %, may cause drawbacks in the extrusion process for producing the insulating layer. Firstly, the dielectric fluid cannot be added to the polymer granules when fed into the extruder, and also it cannot be injected upstream into the extruder barrel, namely in an initial portion of the extruder where the polymeric material is still solid, since the dielectric fluid exerts a remarkable lubricating action on the material, thus causing sliding of the same on the metallic surface of the extruder barrel and screw. Such sliding effect causes instability in the extrusion process, and consequently a poor quality of the insulating layer is observed, especially in terms of increased structural defects. The above drawbacks are particularly evident when the rotation speed of the extruder screw is high, i.e. when a high extrusion speed is requested (e.g. higher than 20 m/min for medium voltage cable). If the extrusion speed is substantially reduced, particularly below 20 m/min for a medium voltage cable, the process becomes unattractive from an industrial point of view.

The solution envisaged in WO 02/47092 to inject the dielectric fluid into the extruder barrel is prone to some drawbacks, since the injection is to be carried out in the terminal part of the extruder wherein the material is molten and completely fills the extruder internal space, therefore injection must be carried out with very high pressures. Consequently, damages on the injection apparatus and also on the manufacturing plant may occur, while the dielectric fluid may remain entrapped therein for a long time, with possible degradation or even burning of the same. Moreover, local accumulation of the dielectric fluid may occur, which can cause an unacceptable bulging of the thermoplastic material forming the electrically insulating layer, such bulging being, in some cases, so expanded to cause a breaking of the outer semiconductive layer.

As regards the possibility of impregnating the polymer granules with the dielectric fluid before feeding them into the extruder, as explained above the prior art teaches that it is mandatory, after the impregnation step, to further improve dispersion of the dielectric fluid into the polymer matrix by subjecting the impregnated material to an additional mechanical processing in the molten state, either before or after the extrusion step, to cause homogenization of the same. For instance, according to WO 02/47092, just downstream of the extrusion step and before deposition on the conductive core, the material is passed through a static mixer to obtain the desired homogeneity, while according to WO 02/27731, to obtain a homogeneous distribution of the dielectric fluid, the thermoplastic material must be passed through multiple mixing steps by extrusion. The above multi-step mixing causes an increased complexity of the production plants. Such increased complexity is not only disadvantageous from the economical point of view, but also can enhance the risk of contamination by pollutants and degradation of the insulating layer.

Therefore, according to a first aspect, the present invention relates to a process for producing an energy cable comprising at least one electrically conductive core and at least one thermoplastic electrically insulating layer, which comprises the steps of:

- impregnating a thermoplastic material in subdivided solid form, having a melting enthalpy equal to or lower than 70 J/g, with a dielectric fluid to obtain an impregnated thermoplastic material;
- feeding said impregnated thermoplastic material in subdivided solid form to a single-screw extruder; and
- extruding the impregnated thermoplastic material onto said at least one electrically conductive core, so as to form said at least one thermoplastic electrically insulating layer;

whereby said impregnated thermoplastic material is not subjected to any mechanical homogenization step in a molten state.

For the purpose of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

In the present description and in the subsequent claims, as "electrically conductive core" it is meant an electrically conducting element usually made from a metallic material, more preferably aluminium, copper or alloys thereof, either as a rod or as a stranded multi-wire, or a conducting element as above coated with a semiconductive layer.

For the purposes of the invention the term "medium voltage" generally means a voltage of between 1 kV and 35 kV, whereas "high voltage" means voltages higher than 35 kV.

As "electrically insulating layer" it is meant a covering layer made of a material having insulating properties, namely having a dielectric rigidity (dielectric breakdown strength) of at least 5 kV/mm, preferably greater than 10 kV/mm.

As "semiconductive layer" it is meant a covering layer made of a material having semiconductive properties, such as a polymeric matrix added with, e.g., carbon black such as to obtain a volumetric resistivity value, at room temperature, of less than 500 Ω·m, preferably less than 20 Ω·m. Typically, the amount of carbon black can range between 1 and 50% by weight, preferably between 3 and 30% by weight, relative to the weight of the polymer.

According to a preferred embodiment, the thermoplastic material is impregnated in the form of granules or pellets, having an average dimension of from 2 to 7 mm, more preferably from 3 to 6 mm.

According to a preferred embodiment, the thermoplastic material is impregnated with an amount of the dielectric fluid of from 8% to 40% by weight, more preferably of from 10% to 30% by weight, even more preferably from 15% to 25% by weight, with respect to the weight of the thermoplastic material.

The impregnation step is preferably carried out in a mixer. The mixer may be, e.g., selected from: ribbon blenders, tumble mixers, turbomixers.

The time required to obtain a complete impregnation mainly depends on the properties of the thermoplastic material and of the dielectric fluid, and also on the efficiency of the mixer and on the impregnation temperature. For example, the impregnation time may range from 10 to 60 minutes, preferably from 15 to 45 minutes. The fact that the thermoplastic material has a melting enthalpy equal to or lower than 70 J/g, preferably from 30 to 60 J/g, allows to obtain a substantially complete absorption of the dielectric fluid, since the thermoplastic material has a reduced crystallinity and therefore is highly compatible with the dielectric fluid, so as to quickly receive even large amounts of the same. At the end of the impregnation step the granules or pellets of the thermoplastic material are substantially dry, with a non-sticky and non-oily surface. This is of great advantage for the subsequent handling and processing of the impregnated material.

Advantageously, the impregnation step may be preceded by a step of heating the thermoplastic material at a temperature of from 30° C. to 110° C., more preferably from 50° C. to 90° C. (pre-heating step). The pre-heating step facilitates the absorption of the dielectric fluid into the thermoplastic material. In the absence of the pre-heating step, the impregnation step may be carried out with satisfactory results thanks to the relatively low melting enthalpy of the thermoplastic material, but with a longer impregnation time. The pre-heating step may be carried out before charging the thermoplastic material into the mixer or after said charging, before adding the dielectric fluid.

The impregnation step can be carried out batchwise, therefore the dimensions of the mixer wherein the impregnation is performed is suitably selected so as to guarantee a continuous feeding of the extrusion apparatus, mainly on the basis of the impregnation time and of the extrusion speed. In some cases, it could be advantageous to provide, between the impregnating and the feeding steps, a step of temporarily storing the impregnated thermoplastic material so as to guarantee a continuous feeding of the extrusion apparatus. During storage, the impregnated thermoplastic material is also subjected to a sort of "maturation", which can further increase absorption and homogeneous distribution of the dielectric fluid into the thermoplastic material.

The process according to the present invention allows to produce energy cables with a high production speed, usually of at least 20 m/min, preferably of at least 30 m/min for medium voltage cables. As to the upper speed limit, it depends on other manufacturing conditions, such as the model and size of extruder or the kind other apparatus downstream the extrusion step; of course, a higher manufacturing speed makes the process more attractive from an industrial point of view. As for the extrusion speed of high voltage energy cables, an improvement of 30-50% can be achieved by the process according to the present invention, taking into account that the high voltage energy cables are usually produced with an extrusion speed of about 1-2 m/min.

After the impregnation step, the impregnated thermoplastic material in subdivided form is preferably directly fed to a single-screw extruder, wherein the material, after an initial kneading in the solid form, is melted and then extruded onto said at least one electrically conductive core, so as to form said at least one thermoplastic electrically insulating layer.

It should be noted that a single screw extruder has as foremost goal that of melting the thermoplastic polymer and building pressure in the so obtained melted material, so that it can be extruded through a die or injected into a mould. Other processing machines, particularly twin screw extruders, not only melt the thermoplastic material, but also exert a remarkable mixing effect on the same. In other words, substantially no mixing of the components of the thermoplastic material can be achieved by using a single screw extruder, while a mixing action is typically performed by a twin screw extruder.

In any event, the process according to the invention does not require any mechanical homogenization step in a molten state of the impregnated material in order to improve dispersion of the dielectric fluid into said thermoplastic material. This is a considerable advantage in terms of productivity as well as of initial and maintenance costs for the production plant. It should be noted that, as explained above, the single screw extruder, used to extrude the impregnated thermoplastic material onto the electrically conductive core, does not exert an actual mechanical homogenization on the material itself.

Moreover, the use of a single-screw extruder has remarkable advantages with respect to twin-screw extruders. As already said above, a single screw extruder can build up a significant pressure on the melted material which thus can be effectively fed to the extrusion head. Conversely, the pressure on the melted material built up by a twin-screw extruder is sometimes insufficient to effectively extrude the thermoplastic material onto the conductive core, thus requiring the addition on a suitable pump to increase the pressure of the melted material before feeding it to the extrusion head.

The thermoplastic material may be constituted by a single thermoplastic polymer or by a mixture of at least two thermoplastic polymers. As reported above, the thermoplastic material has a melting enthalpy equal to or lower than 70 J/g, preferably from 30 to 60 J/g, which is to be intended as the overall melting enthalpy measured on the thermoplastic material by Differential Scanning Calorimetry (DSC) analysis.

According to a preferred embodiment, the thermoplastic polymer material is selected from:

- at least one copolymer (i) of propylene with at least one olefin comonomer selected from ethylene and an α-olefin other than propylene, said copolymer having a melting point greater than or equal to 130° C. and a melting enthalpy of from 20 J/g to 90 J/g;

a blend of at least one copolymer (i) with at least one copolymer (ii) of ethylene with at least one α-olefin, said copolymer (ii) having a melting enthalpy of from 0 J/g to 120 J/g;

a blend of at least one propylene homopolymer with at least one copolymer (i) or copolymer (ii):

at least one of copolymer (i) and copolymer (ii) being a heterophasic copolymer.

With "heterophasic copolymer" it is meant a copolymer in which elastomeric domains, e.g. of ethylene-propylene elastomer (EPR), are dispersed in a propylene homopolymer or copolymer matrix.

The at least one electrically insulating layer can have a thickness of at least 8 mm, for example of at least 12 mm. The thickness of the insulating layer depends on the voltage intended to be carried by the cable and on the overall structure of the cable (conductor compositions and configuration, kind of material employed for the insulating layers, etc.). For example, a polyethylene insulated cable intended for carrying 400 kV and having a single conductor made of stranded copper wires can have an insulating layer 27 mm thick.

Preferably, the thermoplastic polymer material has a melt flow index (MFI), measured at 230° C. with a load of 21.6 N according to ASTM Standard D1238-00, of from 0.05 dg/min to 10.0 dg/min, more preferably from 0.4 dg/min to 5.0 dg/min.

The olefin comonomer in copolymer (i) can be ethylene or an α-olefin of formula $CH_2{=}CH{-}R$, wherein R is a linear or branched $C_2$-$C_{10}$ alkyl, selected, for example, from: 1-butene, 1-pentene, 4-methyl-1-pentene, 1-hexene, 1-octene, 1-decene, 1-dodecene, or mixtures thereof. Propylene/ethylene copolymers are particularly preferred.

The olefin comonomer in copolymer (i) is preferably present in an amount equal to or lower than 15 mol %, more preferably equal to or lower than 10 mol %.

The olefin comonomer in copolymer (ii) can be an olefin of formula $CH_2{=}CH{-}R$, wherein R represents a linear or branched alkyl group containing from 1 to 12 carbon atoms. Preferably, said olefin is selected from propylene, 1-butene, isobutylene, 1-pentene, 4-methyl-1-pentene, 1-hexene, 1-octene, 1-dodecene, or mixtures thereof. Propylene, 1-butene, 1-hexene and 1-octene are particularly preferred.

According to a preferred embodiment, at least one copolymer (ii) is a linear low density polyethylene (LLDPE) copolymer. Preferably the olefin comonomer in LLDPE is present in an amount from 2 to 12 wt %.

According to a preferred embodiment, copolymer (i) or copolymer (ii) or both are random copolymers. With "random copolymer" it is meant a copolymer in which the comonomers are randomly distributed along the polymer chain.

Advantageously, in copolymer (i) or copolymer (ii) or both, when heterophasic, an elastomeric phase is present in an amount equal to or greater than 45 wt % with respect to the total weight of the copolymer.

Particularly preferred heterophasic copolymers (i) or (ii) are those wherein the elastomeric phase consists of an elastomeric copolymer of ethylene and propylene comprising from 15 wt % to 50 wt % of ethylene and from 50 wt % to 85 wt % of propylene with respect to the weight of the elastomeric phase.

Preferred heterophasic copolymers (ii) are propylene copolymers, in particular:

(ii-a) copolymers having the following monomer composition: 35 mol %-90 mol % of ethylene; 10 mol %-65 mol % of an aliphatic α-olefin, preferably propylene; 0 mol %-10 mol % of a polyene, preferably a diene, more preferably, 1,4-hexadiene or 5-ethylene-2-norbornene (EPR and EPDM rubbers belong to this class);

(ii-b) copolymers having the following monomer composition: 75 mol %-97 mol %, preferably 90 mol %-95 mol %, of ethylene; 3 mol %-25 mol %, preferably 5 mol %-10 mol %, of an aliphatic α-olefin; 0 mol %-5 mol %, preferably 0 mol %-2 mol %, of a polyene, preferably a diene (for example ethylene/1-octene copolymers).

Heterophasic copolymers can be obtained by sequential copolymerization of: 1) propylene, possibly containing minor quantities of at least one olefin comonomer selected from ethylene and an α-olefin other than propylene; and then of: 2) a mixture of ethylene with an α-olefin, in particular propylene, optionally with minor portions of a polyene.

The term "polyene" generally means a conjugated or non-conjugated diene, triene or tetraene. When a diene comonomer is present, this comonomer generally contains from 4 to 20 carbon atoms and is preferably selected from: linear conjugated or non-conjugated diolefins such as, for example, 1,3-butadiene, 1,4-hexadiene, 1,6-octadiene, and the like; monocyclic or polycyclic dienes such as, for example, 1,4-cyclohexadiene, 5-ethylidene-2-norbornene, 5-methylene-2-norbornene, vinylnorbornene, or mixtures thereof. When a triene or tetraene comonomer is present, this comonomer generally contains from 9 to 30 carbon atoms and is preferably selected from trienes or tetraenes containing a vinyl group in the molecule or a 5-norbornen-2-yl group in the molecule. Specific examples of triene or tetraene comonomers which may be used in the present invention are: 6,10-dimethyl-1,5,9-undecatriene, 5,9-dimethyl-1,4,8-decatriene, 6,9-dimethyl-1,5,8-decatriene, 6,8,9-trimethyl-1,6,8-decatriene, 6,10,14-trimethyl-1,5,9,13-pentadecatetraene, or mixtures thereof. Preferably, the polyene is a diene.

Preferably, copolymer (i) or copolymer (ii) or both have a melting point of from 140° C. to 180° C.

Preferably, copolymer (i) has a melting enthalpy of from 25 J/g to 80 J/g.

Preferably, copolymer (ii) has a melting enthalpy of from 10 J/g to 90 J/g when heterophasic, and from 50 J/g to 100 J/g when homophasic (substantially free from heterophasic phase).

Advantageously, when the thermoplastic material of the insulating layer comprises a blend of copolymer (i) and copolymer (ii), the ratio between copolymer (i) and copolymer (ii) is of from 1:9 to 8:2, preferably of from 2:8 to 7:3.

Advantageously, when the thermoplastic material of the insulating layer comprises a blend of a propylene homopolymer and at least one of copolymer (i) and copolymer (ii), the ratio between the propylene homopolymer and copolymer (i) or copolymer (ii) or both is of from 0.5:9.5 to 5:5, preferably from 1:9 to 3:7.

Preferably, the thermoplastic material of the insulating layer comprises a blend of a propylene homopolymer with one copolymer (i) and two copolymers (ii); in this case, one of the copolymers (ii) is a heterophasic copolymer, while the other is homophasic.

As to the dielectric fluid, high compatibility between the dielectric fluid and the thermoplastic material is necessary to obtain a microscopically homogeneous dispersion of the dielectric fluid in the polymer material. The dielectric fluid suitable for forming the thermoplastic electrically insulating layer should comprise no polar compounds or only a limited quantity thereof, in order to avoid a significant increase of the dielectric losses.

Preferably, the concentration by weight of said at least one dielectric fluid in said thermoplastic material is lower than the saturation concentration of said dielectric fluid in said thermoplastic material. The saturation concentration of the dielectric fluid in the thermoplastic polymer material may be determined by a fluid absorption method on Dumbell specimens as described, for example, in WO 04/066317.

By using the dielectric fluid in an amount as defined above, thermomechanical properties of the insulating layer are maintained and exudation of the dielectric fluid from the thermoplastic material is avoided.

The at least one dielectric fluid is generally compatible with the thermoplastic material. "Compatible" means that the chemical composition of the fluid and of the thermoplastic material is such as to result into a microscopically homogeneous dispersion of the dielectric fluid into the polymer material upon mixing the fluid into the polymer, similarly to a plasticizer.

According to a further preferred embodiment, the dielectric fluid has a melting point or a pour point of from −130° C. to +80° C.

Suitable dielectric fluids for use in the cable of the invention are described, e.g., in WO 02/03398, WO 02/27731, WO 04/066318, WO 07/048422 and WO 08/058572, all in the Applicant's name.

According to a further preferred embodiment, the dielectric fluid has a predetermined viscosity in order to prevent fast diffusion of the liquid within the insulating layer and hence its outward migration, as well as to enable the dielectric fluid to be easily fed and absorbed by the thermoplastic material in solid subdivided form. Generally, the dielectric fluid of the invention has a viscosity, at 40° C., of from 1 cSt to 100 cSt, preferably of from 5 cSt to 100 cSt (measured according to ASTM standard D445-03).

A dielectric fluid according to the invention has a ratio of number of aromatic carbon atoms to total number of carbon atoms (hereinafter also referred to as $C_{ar}/C_{tot}$) greater than or equal to 0.3. Preferably, $C_{ar}/C_{tot}$ is lower than 1. For example, $C_{ar}/C_{tot}$ is from 0.4 to 0.9. The number of aromatic carbon atoms is intended to be the number of carbon atoms which are part of an aromatic ring. The ratio of number of aromatic carbon atoms with respect to the total number of carbon atoms may be determined according to ASTM standard D3238-95(2000)e1.

Examples of suitable dielectric fluids are: aromatic oils, either monocyclic, polycyclic (condensed or not) or heterocyclic (i.e. containing at least one heteroatom selected from oxygen, nitrogen or sulfur, preferably oxygen), wherein aromatic or heteroaromatic moieties are substituted by at least one alkyl group $C_1$-$C_{20}$, and mixtures thereof. When two or more cyclic moieties are present, such moieties may be linked by an alkenyl group $C_1$-$C_5$.

For example, the dielectric fluid comprises at least one alkylaryl hydrocarbon having the structural formula (I):

(I)

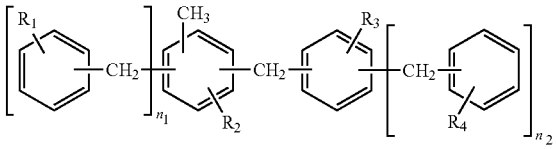

wherein:

$R_1$, $R_2$, $R_3$ and $R_4$, equal or different, are hydrogen or methyl;

$n_1$ and $n_2$, equal or different, are zero, 1 or 2, with the proviso that the sum $n_1+n_2$ is less than or equal to 3.

In another example, the dielectric fluid comprises at least one diphenyl ether having the following structural formula (II):

(II)

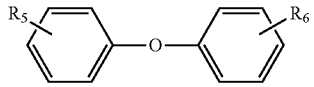

wherein $R_5$ and $R_6$ are equal or different and represent hydrogen, a phenyl group non-substituted or substituted by at least one alkyl group, or an alkyl group non-substituted or substituted by at least one phenyl. By alkyl group it is meant a linear or branched $C_1$-$C_{24}$, preferably $C_1$-$C_{20}$, hydrocarbon radical, with the proviso that the ratio of number of aromatic carbon atoms to total number of carbon atoms is greater than or equal to 0.3.

Alternatively, the dielectric fluid can be selected from mineral oils, for example, naphthenic oils, aromatic oils, paraffinic oils, polyaromatic oils, said mineral oils optionally containing at least one heteroatom selected from oxygen, nitrogen or sulfur; liquid paraffins. Paraffinic oils and naphthenic oils are preferred.

Mineral oils as dielectric fluid can comprise polar compound/s. The amount of polar compound/s advantageously is up to 2.3 wt %. Such a low amount of polar compounds allows obtaining low dielectric losses.

Other components (additives) may be added in minor amounts (for example, from 0.1 wt % to 1 wt % each) to the thermoplastic material, including antioxidants, processing aids, voltage stabilizers, nucleating agents, or mixtures thereof.

In the process according to the present invention, said additives may be possibly added to the thermoplastic material during the impregnation step or during the step of feeding the impregnated thermoplastic material to the single-screw extruder. When an additive is in solid form, it may be advantageously dispersed into the dielectric fluid before impregnation.

Conventional antioxidants suitable for the purpose are, for example, distearyl- or dilauryl-thiopropionate and pentaerythrityl-tetrakis[3-(3,5-di-t-butyl-4-hydroxyphenyl)-propionate], or mixtures thereof. Antioxidants in liquid form or, if solid, soluble or dispersible in the dielectric fluid are preferred in the process of the invention.

Processing aids which may be added to the polymer composition include, for example, calcium stearate, zinc stearate, stearic acid, or mixtures thereof.

According to a preferred embodiment, the cable according to the present invention includes also at least one semiconductive layer. The semiconductive layer is preferably formed by a semiconductive material comprising the thermoplastic material and the dielectric fluid as disclosed above, and at least one conductive filler, preferably a carbon black filler.

The at least one conductive filler is generally dispersed within the thermoplastic material in a quantity such as to provide the material with semiconductive properties, namely to obtain a volumetric resistivity value, at room temperature, of less than 500 Ω·m, preferably less than 20 Ω·m. Typically, the amount of carbon black can range between 1 and 50% by weight, preferably between 3 and 30% by weight, relative to the weight of the polymer.

The use of the same base polymer composition for both the insulating layer and the semiconductive layers is particularly advantageous in producing cables for medium or high voltage, since it ensures excellent adhesion between adjacent layers and hence a good electrical behaviour, particularly at the interface between the insulating layer and the inner semiconductive layer, where the electrical field and hence the risk of partial discharges are higher.

Although the present description is mainly focused on cables for transporting or distributing medium or high voltage energy, the polymer composition of the invention may be used for coating electrical devices in general and in particular cable of different type, for example low voltage cables (i.e. cables carrying a voltage lower than 1 kV), telecommunications cables or combined energy/telecommunications cables, or accessories used in electrical lines, such as terminals, joints, connectors and the like.

BRIEF DESCRIPTION OF THE DRAWING

Further characteristics will be apparent from the detailed description given hereinafter with reference to the accompanying drawing, in which.

DETAILED DESCRIPTION OF THE PREFERRED EMBODIMENTS

Figure 1:
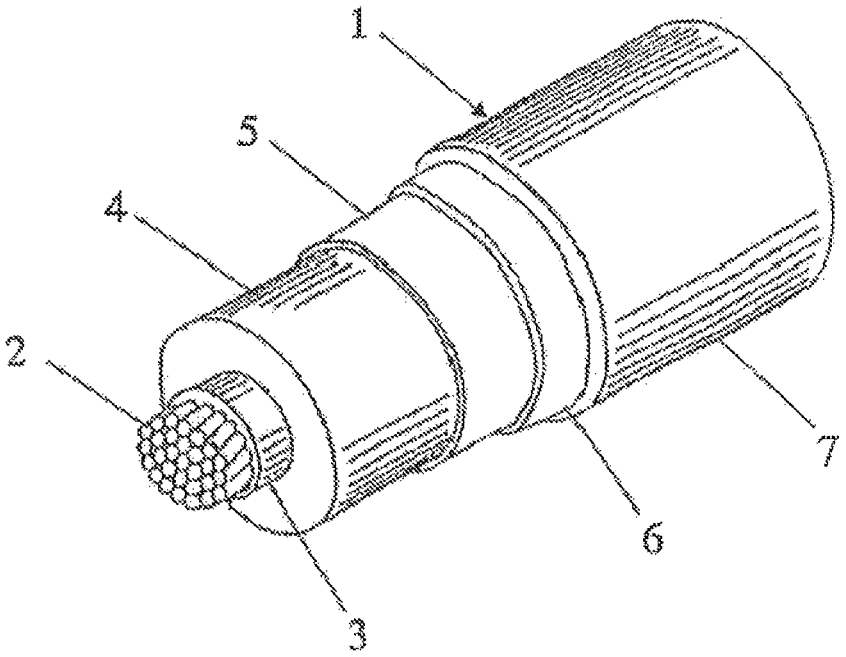
FIG. 1 is a perspective view of an energy cable, particularly suitable for medium or high voltage, which can be produced according to the present invention.

In FIG. 1, the cable (1) comprises a conductor (2), an inner layer with semiconductive properties (3), an intermediate layer with insulating properties (4), an outer layer with semiconductive properties (5), a metal screen layer (6) and a sheath (7). The combination of conductor (2) and inner layer with semiconductive properties (3) corresponds to the electrically conductive core as described above.

The conductor (2) generally consists of metal wires, preferably of copper or aluminium or alloys thereof, stranded together by conventional methods, or of a solid aluminium or copper rod.

The insulating layer (4) is produced according to the present invention. The semiconductive layers (3) and (5) are also made by extruding polymeric materials usually based on polyolefins, preferably a thermoplastic material as described above, which is made semiconductive by adding at least one conductive filler, usually carbon black.

Around the outer semiconductive layer (5), a metal screen layer (6) is usually positioned, made of electrically conducting wires or strips helically wound around the cable core or of an electrically conducting tape longitudinally wrapped and overlapped (preferably glued) onto the underlying layer. The electrically conducting material of said wires, strips or tape is usually copper or aluminium or alloys thereof.

The screen layer (6) may be covered by a sheath (7), generally made from a polyolefin, usually polyethylene.

The cable can be also provided with a protective structure (not shown in FIG. 1) the main purpose of which is to mechanically protect the cable against impacts or compressions. This protective structure may be, for example, a metal reinforcement or a layer of expanded polymer as described in WO 98/52197 in the name of the Applicant.

Figure 2:
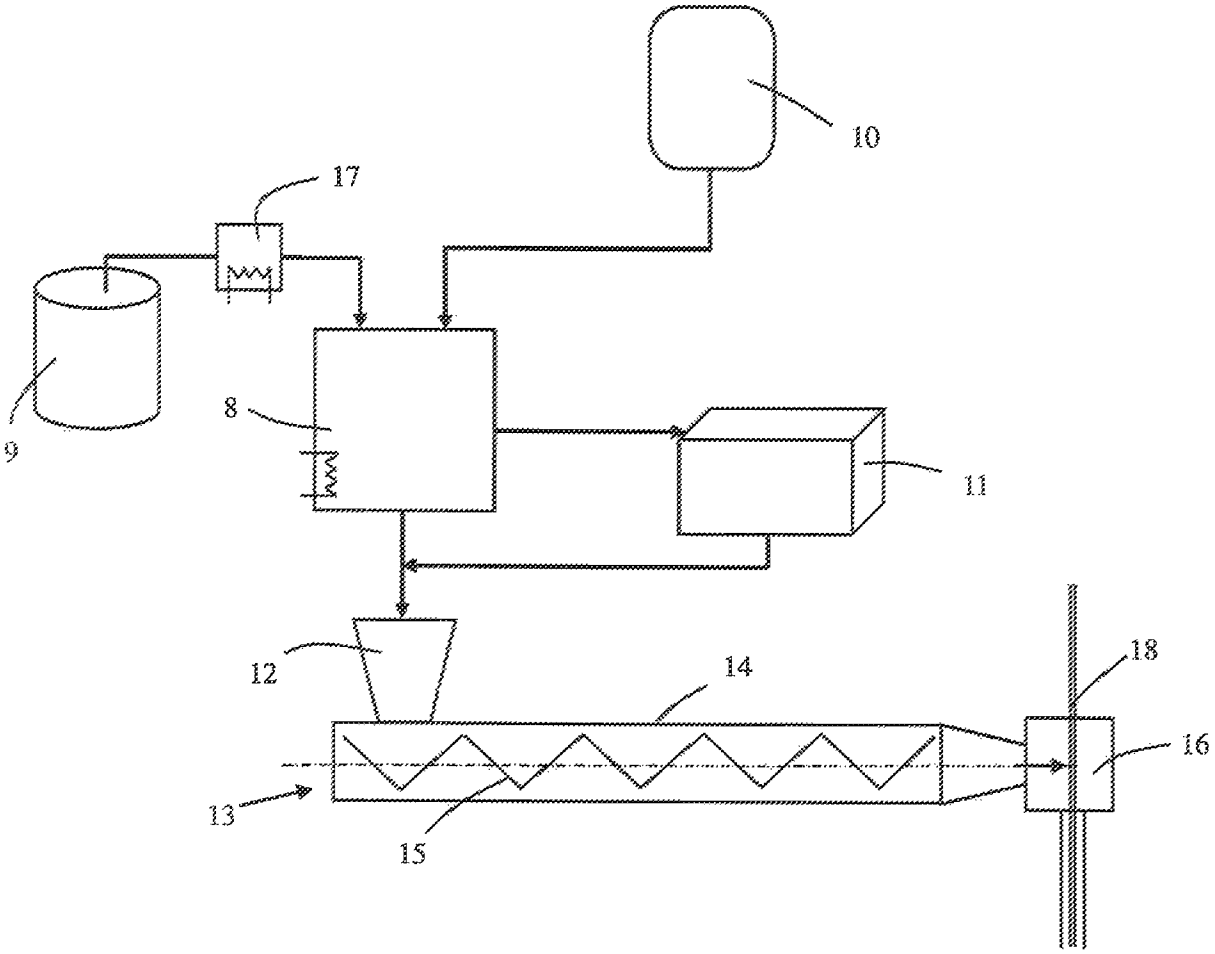
FIG. 2 is a schematic representation of a plant to carry out the process according to the present invention.

In FIG. 2, a schematic representation of a plant to carry out the process according to the present invention is provided. The plant comprises a mixer (8) wherein the thermoplastic material and the dielectric fluid are fed, which may come from, respectively, a pellet container (9) and a tank (10). Before being fed into the mixer (8), the thermoplastic material is preferably heated in a heater (17), for example at a temperature of 50-100° C. Alternatively, the thermoplastic material can be heated into the mixer (8) before the addition of the dielectric fluid and, optionally, of additives, e.g. antioxidant.

In the mixer (8) the step of impregnation occurs, and the impregnated thermoplastic material is then fed to the extruder (13) usually by means of a hopper (12). Advantageously, a storage unit (11) can be provided between the mixer (8) and the hopper (12) in order to temporarily store the impregnated thermoplastic material so as to guarantee a continuous feeding of the extrusion apparatus and a "maturation" of the impregnated material.

The extruder (13) comprises a barrel (14) and a screw (15) wherein the impregnated thermoplastic material (11) is melted and kneaded. The extruder (13) is driven by an engine to cause rotation of the screw and is provided by suitable heating units, in order to heat and melt the polymer material (not represented in FIG. 2), according to well known techniques.

The deposition and shaping of the thermoplastic material is usually carried out by means of an extrusion head (16) placed at the end of the extruder (13).

The extrusion head is preferably a triple extrusion head, which allows to co-extrude onto the conductor, in a single pass, the inner semiconductive layer, the intermediate electrically insulating layer, and the outer semiconductive layer. Alternatively, a tandem method can be performed, wherein individual extruders are arranged in series. Further apparatuses are included in the production plant to provide the cable with the metal screen layer and the sheath.

In the schematic representation of FIG. 2, the thermoplastic insulating material is extruded on a cable core (18), comprising an electrical conductor surrounded by an inner semiconductive layer, by the extrusion head (16). Subsequently, the outer semiconductive layer is formed onto the external surface of the thermoplastic insulating layer by means of another extruder (not represented in FIG. 2).

FIGS. 1 and 2 show only one embodiment of the present invention. Suitable modifications can be made to this embodiment according to specific technical needs and application requirements without departing from the scope of the invention.

The following examples are provided to further illustrate the invention.

EXAMPLES

Two prototype cables were prepared with a laboratory extrusion line, with the same composition of materials but by different manufacturing procedures for the insulating composition. The composition comprised, as polymeric base, a first polypropylene copolymer having a melting enthalpy of 30 J/g and a second polypropylene copolymer having a melting enthalpy of 65 J/g, the first and second polypropylene copolymer being in a weight ratio of 75/25. As dielectric fluid, a naphthenic oil having a viscosity of 25 cSt (at 40° C.) was used. The composition further comprised an antioxidant in an amount of 0.3 wt % which was added to the thermoplastic material together with the dielectric fluid.

Both prototypes had a 70 $mm^2$ aluminum conductor and were extruded with a catenary line. The semiconductive composition, the same in both cables, was the same thermoplastic polypropylene composition as indicated above, added with conductive carbon black.

The insulation of the first cable was prepared and extruded as follows. Polypropylene pellets were charged in a turbomixer, mixed and heated up to 90° C. Upon reaching said temperature, a dielectric fluid in an amount of 15 wt % was added to the polypropylene pellets and the mixing was continued at 90° C. After 25 minutes of mixing, the dielectric fluid was absorbed by the polypropylene pellets, which resulted to be dry. The polypropylene/dielectric fluid material was discharged and fed into a single screw extruder and the extrusion was carried out with the following extrusion temperature profile:

zone 1: 160° C.; zone 2: 180° C.; zone 3: 200° C.; zone 4: 200° C.; zone 5: 200° C.; zone 6: 210° C. The screw rotation speed was 7 rpm.

The insulation of the second cable was extruded by directly injecting 15 wt % of dielectric fluid in the barrel of an identical single screw extruder as used above. Polypropylene feeding was carried out with pellets as obtained from the raw material supplier, without any preliminary treatments. The extrusion temperature profile was the same as indicated above. The screw speed was 10 rpm.

The insulation extrusion speed was initially fixed at 2 m/min for both cables and apparently no significant phenomena were observed. Then, the extrusion speed was increased to 3 m/min: in the second cable quite evident morphological defects appeared, due to the incomplete mixing and absorption of the dielectric fluid. These defects significantly affected the insulation quality and cannot be tolerated. Moreover, an abnormal bulging of the insulation layer was observed in some points of the extruded cable, with breakage of the outer semiconductive layer, due to local accumulation of the dielectric fluid. Conversely, the insulation layer of the first cable, obtained by the process according to the present invention, showed no defects at 3 m/min speed.

The invention claimed is:

1. A process for producing an energy cable comprising at least one electrically conductive core and at least one thermoplastic electrically insulating layer, which comprises the steps of:

impregnating a thermoplastic material in subdivided solid form, having a melting enthalpy equal to or lower than 70 J/g, with a dielectric fluid to obtain an impregnated thermoplastic material;

feeding said impregnated thermoplastic material in subdivided solid form to a single-screw extruder; and extruding the impregnated thermoplastic material by means of the single-screw extruder onto said at least one electrically conductive core, so as to form said at least one thermoplastic electrically insulating layer, whereby said impregnated thermoplastic material is not subjected to any mechanical homogenization step in a molten state.

2. The process according to claim 1, wherein the thermoplastic material is impregnated in the form of granules or pellets, having an average dimension of from 2 to 7 mm.

3. The process according to claim 2, wherein the thermoplastic material is impregnated in the form of granules or pellets, having an average dimension of from 3 to 6 mm.

4. The process according to claim 1, wherein the thermoplastic material is impregnated with an amount of the dielectric fluid of from 8% to 40% by weight, with respect to the weight of the thermoplastic material.

5. The process according to claim 4, wherein the thermoplastic material is impregnated with an amount of the dielectric fluid of from 0% to 30% by weight, with respect to the weight of the thermoplastic material.

6. The process according to claim 4, wherein the thermoplastic material is impregnated with an amount of the dielectric fluid of 15% to 25% by weight, with respect to the weight of the thermoplastic material.

7. The process according to claim 1, wherein the impregnation step is carried out on the thermoplastic material pre-heated at a temperature of from 30° C. to 110° C.

8. The process according to claim 7, wherein the impregnation step is carried out on the thermoplastic material pre-heated at a temperature of from 50° C. to 90° C.

9. The process according to claim 1, comprising temporarily storing the impregnated thermoplastic material between the impregnating and the feeding steps.

10. The process according to claim 1, wherein a medium voltage energy cable is produced with a production speed of at least 20 m/min.

11. The process according to claim 10, wherein a medium voltage energy cable is produced with a production speed of at least 30 m/min.

12. The process according to claim 1, wherein the thermoplastic material has a melting enthalpy from 30 to 60 J/g.

13. The process according to claim 1, wherein the thermoplastic material is selected from:

at least one copolymer (i) of propylene with at least one olefin comonomer selected from ethylene and an α-olefin other than propylene, said copolymer having a melting point greater than or equal to 130° C. and a melting enthalpy of from 20 J/g to 70 J/g;

a blend of at least one copolymer (i) with at least one copolymer (ii) of ethylene with at least one α-olefin, said copolymer (ii) having a melting enthalpy of from 0 J/g to 120 J/g; and a blend of at least one propylene homopolymer with at least one copolymer (i) or copolymer (ii), at least one of copolymer (i) and copolymer (ii) being a heterophasic copolymer.

14. The process according to claim 1, wherein the dielectric fluid has a melting point or a pour point of from −130° C. to +80° C.

15. The process according to claim 1, wherein the dielectric fluid has a viscosity, at 40° C., of from 1 cSt to 100 cSt (measured according to ASTM standard D445-03).

16. The process according to claim 15, wherein the dielectric fluid has a viscosity, at 40° C., of from 5 cSt to 100 cSt (measured according to ASTM standard D445-03).

17. The process according to claim 1, wherein the dielectric fluid is selected from: aromatic oils, either monocyclic, polycyclic (condensed or not) or heterocyclic, wherein aromatic or heteroaromatic moieties are substituted by at least one alkyl group $C_1$-$C_{20}$, and mixtures thereof, and wherein, when two or more cyclic moieties are present, such moieties may be linked by an alkenyl group $C_1$-$C_5$.

18. The process according to claim 1, wherein the dielectric fluid is selected from: mineral oils, naphthenic oils, aromatic oils, paraffinic oils, polyaromatic oils, said mineral oils optionally containing at least one heteroatom selected from oxygen, nitrogen or sulfur; and liquid paraffins.

19. The process according to claim 1, wherein one or more additives selected from: antioxidants, processing aids, voltage stabilizers, and nucleating agents, are added to the thermoplastic material during the impregnation step.

20. The process according to claim 19, wherein one or more additives in solid form are dispersed into the dielectric fluid before impregnation.

* * * * *